US011048201B2

(12) United States Patent
Ito

(10) Patent No.: US 11,048,201 B2
(45) Date of Patent: Jun. 29, 2021

(54) SHEET FEEDING APPARATUS AND IMAGE FORMING APPARATUS

(71) Applicant: CANON FINETECH NISCA INC., Misato (JP)

(72) Inventor: Toshiyuki Ito, Minami-alps (JP)

(73) Assignee: Canon Finetech Nisca, Inc., Misato (JP)

( * ) Notice: Subject to any disclaimer, the term of this patent is extended or adjusted under 35 U.S.C. 154(b) by 303 days.

(21) Appl. No.: 16/218,512

(22) Filed: Dec. 13, 2018

(65) Prior Publication Data

US 2019/0196387 A1 Jun. 27, 2019

(30) Foreign Application Priority Data

Dec. 21, 2017 (JP) ..... JP2017-245363
Dec. 5, 2018 (JP) ..... JP2018-228301

(51) Int. Cl.
*G03G 15/00* (2006.01)
*G03G 21/16* (2006.01)

(52) U.S. Cl.
CPC ..... *G03G 15/6555* (2013.01); *G03G 15/6502* (2013.01); *G03G 15/6508* (2013.01); *G03G 15/6511* (2013.01); *G03G 21/1647* (2013.01); *G03G 2221/1675* (2013.01)

(58) Field of Classification Search
CPC ..... G03G 15/6555; G03G 15/6502; G03G 15/6508; G03G 15/6511; G03G 21/1647; G03G 2221/1675
See application file for complete search history.

(56) References Cited

U.S. PATENT DOCUMENTS 7,682,096 B2 * 3/2010 Matsushima ..... B41J 29/02 400/693
10,145,149 B2 * 12/2018 Westwinkel ..... E05B 65/464
2010/0038278 A1 * 2/2010 Gattefosse ..... B65D 50/046 206/531
2017/0045921 A1 * 2/2017 Norton ..... G06F 1/181
2017/0164736 A1 * 6/2017 Shoham ..... A47B 88/919
2018/0171689 A1 * 6/2018 Kalathil ..... E05O 1/145

FOREIGN PATENT DOCUMENTS

JP 2007-121858 A 5/2007

* cited by examiner

*Primary Examiner* — David H Banh
(74) *Attorney, Agent, or Firm* — Venable LLP

(57) ABSTRACT

Occurrence of a half-latch state when pushing a sheet stacking unit into a sheet feeding apparatus at an angle can be prevented. More specifically, inside a sheet feeding apparatus that accommodates and fixes the sheet stacking unit, a latch assembly in which left and right latches and a connecting portion that connects the two latches are configured and that operates integrally is provided. By this, even when one roller of the sheet stacking unit contacts one latch which rides up on the roller in a case where the sheet stacking unit is pushed into the sheet feeding apparatus at an angle, it is possible to hold off on engagement of the latches until the other roller passes the other latch.

4 Claims, 6 Drawing Sheets

SHEET FEEDING APPARATUS AND IMAGE FORMING APPARATUS

BACKGROUND OF THE INVENTION

Field of the Invention

The present invention relates to a sheet feeding apparatus and an image forming apparatus, and particularly to a sheet feeding apparatus that can stack a large amount of sheets and an image forming apparatus.

Description of the Related Art

Conventionally, there have been sheet stacking apparatuses that use a storage compartment that can be inserted and removed by a slide rail and are capable of stacking a large number of sheets. In such an apparatus, as is proposed by Japanese Patent Laid-Open No. 2007-121858, for example, two latch (lock) (left and right) mechanisms that are coupled so as to hold a storage compartment when it is closed by an operator are used.

However, in the foregoing conventional example, in a case where the storage compartment is pushed not straight but at an angle with respect to the sheet stacking apparatus, only one of the latches will be engaged, and the other latch will not be engaged (half-latched). The state in which the second latch is not engaged (half-latched) is a state in which the first latch comes down before the second latch is engaged. When such a state occurs, there is the possibility that jams occur during sheet feeding, normal sheet feeding will cease to be possible, the storage compartment itself will deform, or sheet accommodability will be degraded.

SUMMARY OF THE INVENTION

Accordingly, the present invention is conceived as a response to the above-described disadvantages of the conventional art.

For example, a sheet feeding apparatus and an image forming apparatus according to this invention is capable of preventing the occurrence of a half-latched state with a simple and inexpensive configuration.

According to one aspect of the present invention, there is provided a sheet feeding apparatus that feeds sheets to an image forming apparatus comprising: a housing; a storage unit that is accommodated within the housing and that has a sheet stacking unit that stacks sheets, and that is movable in an insertion direction with respect to the housing; a first rotating body arranged at one end in a direction that intersects with the insertion direction of the storage unit; a second rotating body arranged at the other end in the direction that intersects with the insertion direction of the storage unit; a first latch portion that is provided in the housing and engages with the first rotating body; a second latch portion that is provided in the housing and engages with the second rotating body; a connecting portion that connects the first latch portion and the second latch portion; and a feed unit configured to feed a sheet stacked in the sheet stacking unit to the image forming apparatus, wherein the housing includes the first latch portion, the second latch portion, the connecting portion, and the feed unit, the storage unit includes the first rotating body and the second rotating body, the first latch portion and the second latch portion are connected by the connecting portion and move integrally, in a case where the storage unit is inserted at a maximum angle with respect to the housing, the first latch portion does not engage with the first rotating body and the second latch portion does not engage with the second rotating body at a time when the first rotating body reaches an engagement position for the first latch portion in the insertion direction and the second rotating body does not reach an engagement position for the second latch portion in the insertion direction, and the first latch portion engages with the first rotating body and the second latch portion engages with the second rotating body at a time when the first rotating body reaches the engagement position for the first latch portion in the insertion direction and the second rotating body reaches the engagement position for the second latch portion in the insertion direction.

According to another aspect of the present invention, there is provided a sheet feeding apparatus comprising: a housing; a storage unit that is accommodated within the housing and that has a sheet stacking unit that stacks sheets, and that is movable in an insertion direction with respect to the housing and an opposite direction of the insertion direction; a first rotating body arranged at one end in a direction that intersects with the insertion direction of the storage unit; a second rotating body arranged at the other end in a direction that intersects with the insertion direction of the storage unit; a first latch portion that is provided in the housing and engages with the first rotating body; a second latch portion that is provided in the housing and engages with the second rotating body; a connecting portion that connects the first latch portion and the second latch portion; and a feed unit configured to feed the sheets stacked in the sheet stacking unit to an image forming apparatus, wherein the housing includes the first latch portion, the second latch portion, the connecting portion, and the feed unit, the storage unit includes the first rotating body and the second rotating body, the first latch portion and the second latch portion are connected by the connecting portion, the first latch portion and the second latch portion both include: from its head towards the insertion direction, an inclined face portion that inclines with respect to the insertion direction; a short side portion that is connected to the inclined face portion and forms an angle with the insertion direction, the angle being smaller than an angle between the inclined face portion and the insertion direction; and a concave portion that connects to the short side portion and engages with a corresponding rotating body, and in a case where the storage unit is inserted at a maximum angle with respect to the housing, a length in the insertion direction from a position of the inclined face portion at which a corresponding rotating body initially contacts to a position at which the concave portion connects to the short side portion is longer than a distance in the insertion direction between the first rotating body and the second rotating body.

According to still another aspect of the present invention, there is provided an image forming apparatus comprising a sheet feeding apparatus of the above-described configuration and an image forming unit configured to form an image onto a sheet that the sheet feeding apparatus feeds.

The invention is particularly advantageous since it can prevent a half-latched state by using a latch assembly in which two latches operate in an integrated fashion.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings. However, the present invention is not limited to embodiments to be described below, and changes and additions may be made without departing from the scope of the present invention.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

<Configuration of Image Forming System (FIGS. 1-2)>

Figure 1:
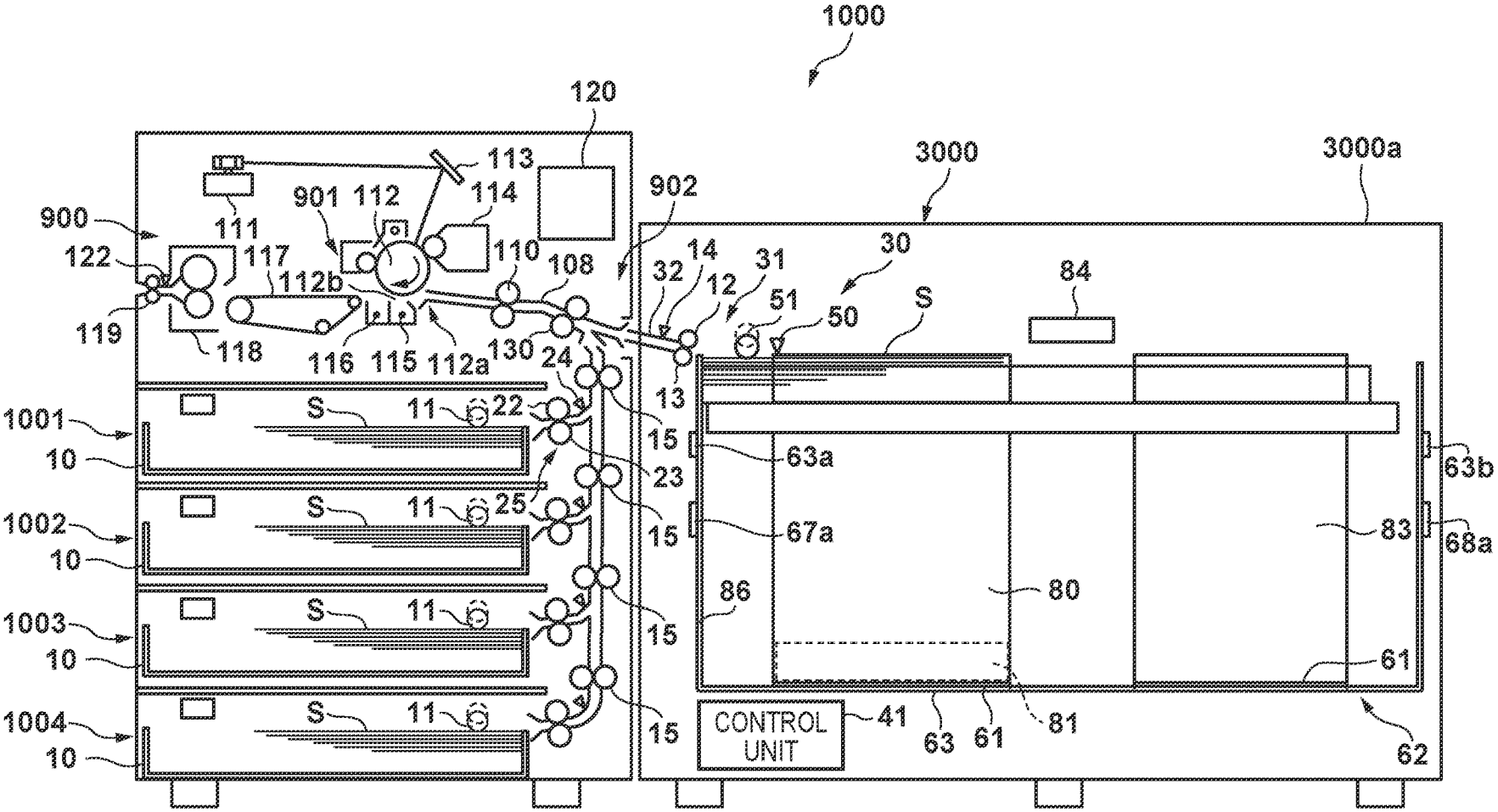
FIG. 1 is a side sectional view showing the schematic arrangement of an image forming apparatus that includes a sheet feeding apparatus according to an exemplary embodiment of the present invention.

FIG. 1 is a side sectional view showing the schematic arrangement of an image forming system 1000 that forms an image in accordance with an electrophotographic method according to an exemplary embodiment of the present invention.

As shown in FIG. 1, the image forming system 1000 includes an image forming apparatus (LBP) 900 and a paper deck 3000 connected to the image forming apparatus 900. The paper deck 3000 includes a control unit 41 with a CPU, a RAM, and a ROM, which controls the paper deck 3000 in accordance with a command of a controller 120 that controls the entire image forming system 1000.

The image forming apparatus 900 includes first to fourth sheet feeding apparatuses 1001 to 1004 of the same arrangement that feed sheets S and a sheet conveying apparatus 902 that conveys the sheets S fed by the sheet feeding apparatuses 1001 to 1004 to an image forming unit 901. The controller 120 provided in the image forming apparatus 900 includes the CPU, the RAM, and the ROM in order to control the respective units of the image forming system 1000. In addition, the controller 120 generates an image signal upon receiving image data from the outside (for example, a PC or the like) and outputs this to the image forming unit.

Each of the first to fourth sheet feeding apparatuses 1001 to 1004 includes a sheet feed cassette 10 that stores the sheets S, a pickup roller 11, and a separation/conveyance roller pair 25 constituted by a feed roller 22 and a retard roller 23. Each sheet S stored in the sheet feed cassette 10 is separated and fed by the pickup roller 11 and the separation/conveyance roller pair 25 each performing a vertical moving operation and rotating at a predetermined timing. A feeding sensor 24 is arranged near the downstream side of the roller 22 and retard roller 23 in a sheet feeding direction. The feeding sensor 24 detects passage of the sheets S, and transmits a detection signal to the controller 120.

The sheet conveying apparatus 902 includes conveyance roller pairs 15, a pre-registration roller pair 130, and a registration roller pair 110. The sheet S fed from each of the first to fourth sheet feeding apparatuses 1001 to 1004 is passed through a sheet conveyance path 108 by the conveyance roller pairs 15 and the pre-registration roller pair 130, and then guided to the registration roller pair 110. Subsequently, the sheet S is fed to the image forming unit 901 at a predetermined timing by the registration roller pair 110.

The image forming unit 901 includes, for example, a photosensitive drum 112, a laser scanner 111, a developing device 114, a transfer charger 115, and a separation charger 116. Then, at the time of image formation, laser light from the laser scanner 111 driven by an image signal from the controller 120 is deflected by a mirror 113, and the photosensitive drum 112 that rotates in a clockwise direction is irradiated with the laser light, forming an electrostatic latent image on the photosensitive drum. Furthermore, the electrostatic latent image thus formed on the photosensitive drum is then visualized as a toner image by the developing device 114.

Subsequently, the toner image on the photosensitive drum is transferred to the sheet S by the transfer charger 115 in a transfer unit 112*b*. Furthermore, the sheet S to which the toner image is thus transferred is conveyed to a fixing apparatus 118 by a conveyance belt 117 after electrostatic separation from the photosensitive drum 112 by the separation charger 116, and then discharged by discharge rollers 119. Note that the image forming unit 901 and the fixing apparatus 118 form an image on the sheet S fed from a sheet feeding apparatus 30 (or the sheet feeding apparatuses 1001 to 1004).

A discharge sensor 122 is arranged in a conveyance path between the fixing apparatus 118 and the discharge rollers 119. Based on a detection signal of the discharge sensor 122, the controller 120 detects passage of the discharged sheet S.

Furthermore, in the above-described embodiment, the description has been given by taking an image forming apparatus (printer apparatus) having a single function as an example. However, the present invention is not limited to this. The present invention is also applicable to, for example, a copying machine system that integrates an image reading apparatus (scanner apparatus), the image forming apparatus, and an ADF device or may be implemented by adopting a multifunctional system obtained by further adding a facsimile function to the copying machine system.

Furthermore, the description has been given assuming that the image forming unit of the above-described image forming apparatus includes a mechanism that forms an image in accordance with the electrophotographic method. However, the present invention is not limited to this. The present invention may be implemented by adopting, for example, an image forming unit that forms an image in accordance with an inkjet method.

An embodiment regarding the paper deck 3000 serving as a large-volume deck will be described next by taking, as an example, the paper deck 3000 as the sheet feeding apparatus 30 of the image forming system 1000 configured as described above.

Figure 2:
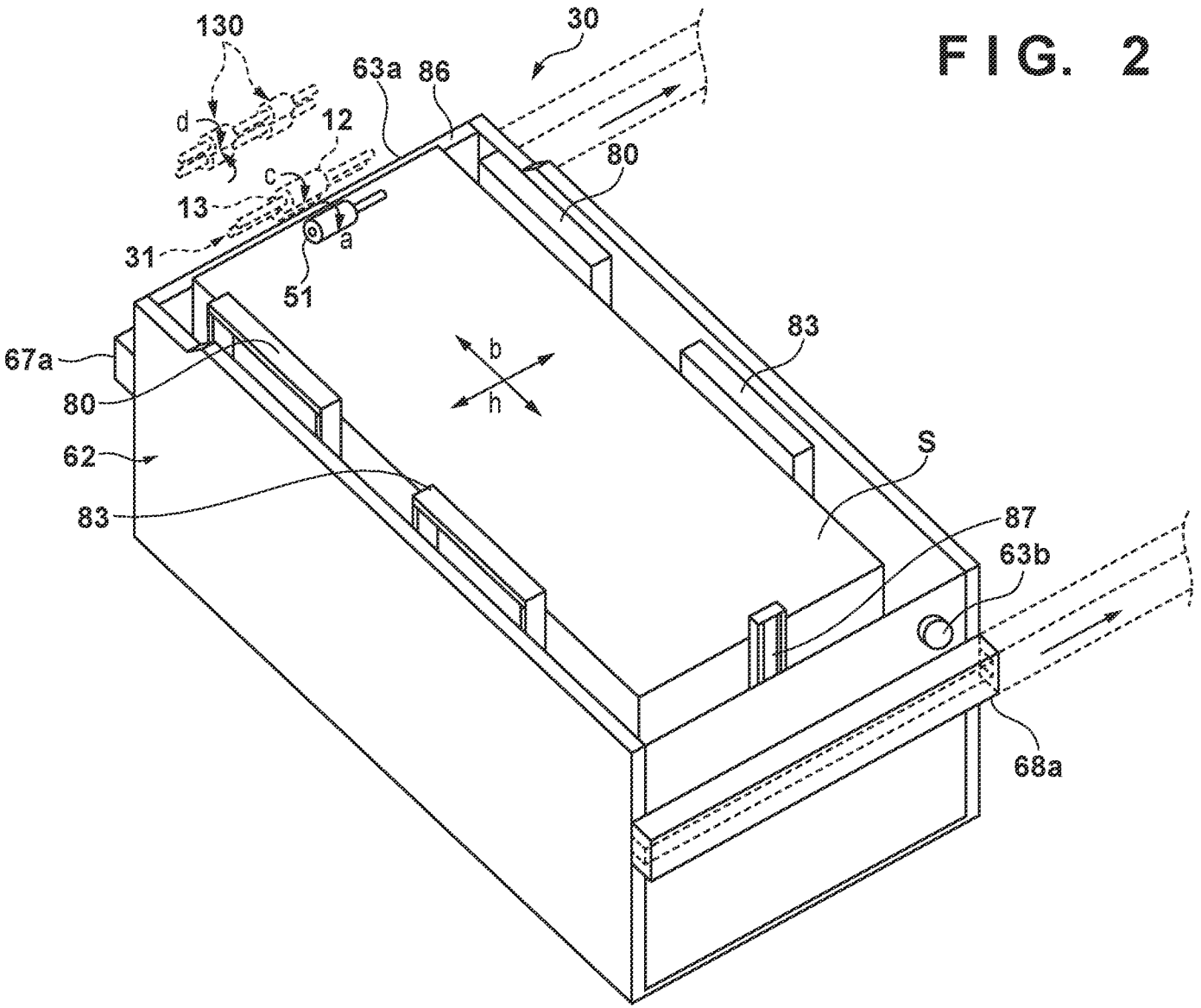
FIG. 2 is a perspective view showing, in a state in which a cover is removed, a main part of a sheet stacking unit.

FIG. 2 is a perspective view showing, in a state in which a cover is removed, a main part of a paper deck 3000.

As shown in FIGS. 1 and 2, the paper deck 3000 includes an apparatus main body 3000*a*, a large-volume sheet storage 62 accommodated in the apparatus main body 3000*a*, and a sheet feeding apparatus 30. The sheet feeding apparatus 30 feeds sheets S stacked/stored in the sheet storage 62, having an approximately rectangular parallelepiped shape, accommodated in the sheet feeding apparatus to an image forming unit 901.

The sheet feeding apparatus 30 includes a sheet stacking tray 61 that stacks sheets S, a pickup roller 51 that feeds the sheets S stacked on the sheet stacking tray 61, and a separation/conveyance roller pair 31 constituted by a feed roller 12 and a retard roller 13. The pickup roller 51 is arranged near a leading end portion in a sheet feeding direction (the direction of an arrow b) to be brought into tight contact with the uppermost sheet on the sheet stacking tray 61 by an appropriate force. For this reason, the pickup roller 51 is provided above the sheet stacking tray 61, contacts the uppermost sheet of the sheets S stacked on the raised sheet stacking tray 61, and feeds the sheet in the direction of the arrow b.

The sheet stacking tray 61 can stack sheets and is supported so as to undergo a vertical moving operation by a driving mechanism (not shown) that includes a vertical moving motor (not shown). An upper surface detection sensor 50 is arranged on the upstream side of the pickup roller 51 on the upper side of the sheet stacking tray 61. The upper surface detection sensor 50 is located above the sheet stacking tray 61 and detects an upper surface 68 of the sheet S on the sheet stacking tray. When the sheet stacking tray 61 is lowered the most, the sheet stacking tray 61 contacts a base plate 63 of the sheet feeding apparatus 30. As indicated by a dotted line 81 in FIG. 1, the sheet stacking tray 61 rises when the volume of stacked sheets decreases.

The sheet feeding apparatus 30 includes the sheet stacking tray 61 and two pairs of side restriction members 80 and 83. With respect to the feeding direction (the direction of an arrow b in FIG. 2), the pair of side restriction members 80 is provided on a downstream side of a reference line defined as a center of a sheet, having a maximum length, stackable on the sheet stacking tray 61. On the other hand, the pair of side restriction members 83 is provided on an upstream side of the reference line. The side restriction members 80 and 83 are arranged such that side end positions in a widthwise direction (the direction of an arrow h in FIG. 2) perpendicular to the feeding direction (the direction of the arrow b in FIG. 2) of the sheets S stacked on the sheet stacking tray 61 can be restricted, and both of them can move in the widthwise direction. Particularly, the pair of the side restriction members 83 can move in the widthwise direction (the direction of the arrow h in FIG. 2) perpendicular to the feeding direction by a driving motor. A CPU of the control unit 41 controls the movement.

In this embodiment, the pickup roller 51 is configured to be brought into tight contact with the uppermost sheet of the sheets S on the sheet stacking tray by an appropriate force, as described above. Each sheet S on the sheet stacking tray 61 is separated and fed by the pickup roller 51 with the separation/conveyance roller pair 31 each performing a vertical moving operation and rotating at a predetermined timing.

In a connecting portion 14 with an image forming apparatus 900 of the paper deck 3000, a connecting conveyance path 32 that feeds the sheet S from the side of the paper deck 3000 to a pre-registration roller pair 130 on the side of the image forming apparatus 900 is arranged.

The two pairs of the side restriction members 80 and 83 are configured to be able to guide the sheets S on the sheet stacking tray 61 by sliding up to the widths of all sheet sizes compatible with specifications. That is, the two pairs of the side restriction members 80 and 83 are supported to be movable in a sheet widthwise direction and restrict the both sides positions of the sheets S by contacting the both end portions of the stacked sheets S. Note that a leading end restriction unit 86 in FIG. 2 restricts the leading end portion of each sheet S on the sheet stacking tray 61.

In addition, a trailing end restriction member 87 is arranged so as to restrict the trailing end portion of each sheet S on the sheet stacking tray 61. The trailing end restriction member 87 is supported to be movable in a direction parallel to the sheet feeding direction (the direction of the arrow b) and restricts the trailing end position of each sheet S. The trailing end restriction member 87 is moved along an elongated positioning hole portion 61 (not shown) formed in the center portion of the sheet stacking tray 61.

As shown in FIG. 2, when the pickup roller 51 is driven by a driving motor (not shown) to rotate in a direction (the direction of an arrow a) of feeding the sheets S, the uppermost sheet S is fed in the direction of the arrow b. Consequently, the sheet S contacts a nip portion of the separation/conveyance roller pair 31 adjacent to the exist side of the pickup roller 51.

When double feed of the sheets S fed by the pickup roller 51 occurs, the following operation is performed. That is, the retard roller 13 that is driven to/rotates in a direction opposite to the feed roller 12 that rotates in the same direction as the arrow a (the direction of an arrow c) rotates in the same direction as the feed roller 12 by the intervention of two or more sheets S in the nip portion. Then, the second and subsequent sheets S in the nip portion are pushed back in the direction of the sheet stacking tray 61 by the retard roller 13, and only one uppermost sheet S is fed in the direction of the arrow b by the feed roller 12.

When the sheet S is fed from the paper deck 3000 having the above arrangement or one of the aforementioned first to fourth sheet feeding apparatuses 1001 to 1004, the leading end of the sheet S abuts against the nip portion of the pre-registration roller pair 130. The pre-registration roller pair 130 is formed by a pair of counter rollers and arranged on a conveyance path of the sheet S to be rotatable in the direction of an arrow d in FIG. 2 by a driving motor (not shown). The sheet S that once abuts against the nip portion of the pre-registration roller pair 130 is conveyed to the inside of the image forming apparatus 900 by the pre-registration roller pair 130 that rotates in accordance with a feeding timing.

Giving description with reference to FIG. 1 again, the sheet storage (sheet stacking unit) 62 storing a large number of sheets stacked in the sheet feeding apparatus 30 can move along the rails 67*a* and 68*a* in a direction orthogonal to the sheet surface of FIG. 1, and can be removed and inserted by the user. As further illustrated in FIG. 2, the rails 67*a* and 68*a* are configured to be extendable in the arrow directions, and the shell of the rails 67*a* and 68*a* can be extended as illustrated by the dashed lines. The rails 67*a* and 68*a* engage the rails attached to the interior of the sheet feeding apparatus 30 as described later. Due to the engagement of the rails, the user can easily push the sheet storage 62 into the sheet feeding apparatus 30.

Rollers 63*a* and 63*b* are arranged as rotating bodies at both ends in the lengthwise direction of the sheet storage 62, respectively. When the user has pushed the sheet storage 62 into the sheet feeding apparatus 30, the later described latches and the rollers 63*a* and 63*b* engage. Also, the sheet storage 62 is fixed to the sheet feeding apparatus 30.

Figure 3:
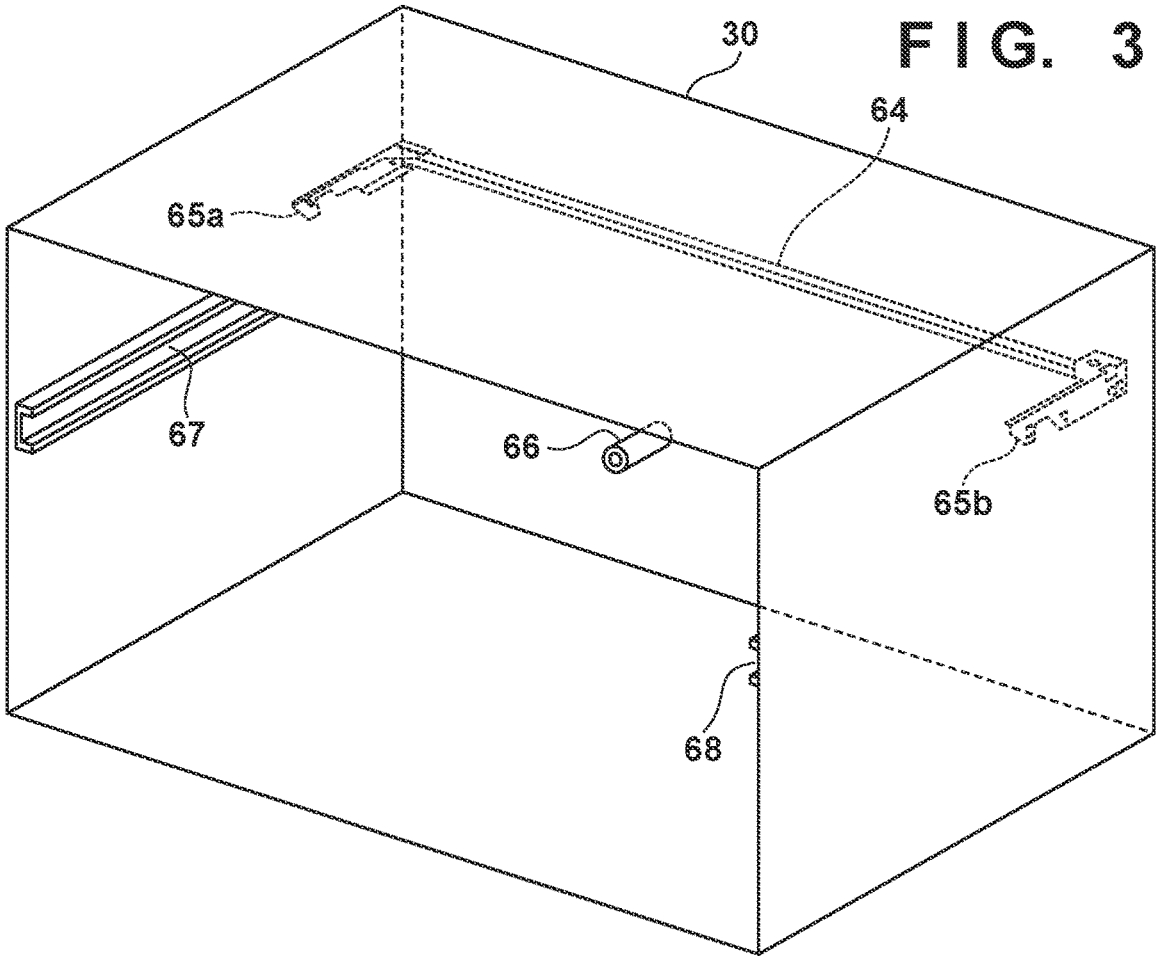
FIG. 3 is a perspective view illustrating the internal structure of the sheet feeding apparatus exhibiting a state in which the sheet storage (sheet stacking unit) is removed.

FIG. 3 is a perspective view illustrating the internal structure of the sheet feeding apparatus indicating a state in which the sheet storage (sheet stacking unit) is removed.

As illustrated in FIG. 3, rails 67 and 68 are attached opposing each other at both ends of the inner walls in the lengthwise direction of the sheet feeding apparatus 30. The rails 67 and 68 respectively accept and engage the rails 67*a* and 68*a* arranged at both ends of the lengthwise direction of the sheet storage 62 described with reference to FIG. 2. Also, when the user pushes the sheet storage (sheet stacking unit) 62 into the sheet feeding apparatus 30, the sheet storage 62 moves inside along the engaged rails.

Furthermore, the latch assembly is configured by latches 65*a* and 65*b* of the same size and same shape and a latch connecting portion 64 that the latches are joined to is arranged inside the sheet feeding apparatus 30. The latch assembly can rotate about the extending direction of the latch connecting portion 64 as the axis and configuration is such that, by a biasing member (not shown), the latch assembly always rotates in the direction in which the leading edges of the latches 65*a* and 65*b* move downward. Also, a stopper mechanism (not shown) is arranged such that the latches 65*a* and 65*b* do not move below the position at which they engage with the rollers 63*a* and 63*b*. The rollers 63*a* and 63*b* arranged at both ends in the lengthwise direction of the sheet storage 62 perform an engagement operation of approaching the latches 65*a* and 65*b* while moving downward (engagement operation hereinafter) when the sheet storage 62 is pushed into the sheet feeding apparatus 30. By this, each latch is engaged and the sheet storage 62 is fixed. A detailed process of this engagement is described later. Also, as can be understood from FIG. 3, the latch connecting portion 64 connects the ends opposite to the leading end portions which contact and engage with the rollers corresponding to each latch.

When only one of the two latches, for example, contacts a roller and is lifted, the other latch not contacting a roller is similarly lifted because the latch assembly integrally moves.

Also, a storage compartment pushing member 66 is arranged at the inner wall of the deepest part of the sheet feeding apparatus 30. The storage compartment pushing member 66 has a built-in spring and enters a state in which the spring retracts at a position where the rollers 63*a* and 63*b* engage the latches 65*a* and 65*b* to fix the sheet storage 62. Accordingly, when the sheet storage 62 is released from the fixed state, the sheet storage 62 is pushed to the outside from the sheet feeding apparatus 30 by repulsive force of the spring.

More specifically, in a case where the user is to stack sheets onto the sheet stacking tray 61, the following operation is performed. When the user presses a storage compartment release button (not shown) arranged on the top of the sheet feeding apparatus 30, the above described latches disconnect. Also, the sheet storage 62 is pushed out by repulsive force of the above described spring. The user can manually pull out the sheet storage 62 after that. In this way, after the sheet storage 62 is caused to move to a position where sheets S can be stacked on the sheet stacking tray 61, the user stacks the sheets S onto the sheet stacking tray 61 and pushes the sheet storage 62 back inside the sheet feeding apparatus 30.

Note, clearance is given between the rails 67 and 68 of the sheet feeding apparatus 30 and the rails 67*a* and 68*a* of the sheet storage 62 side. This is because the clearance enables the sheet storage 62 to slide smoothly when engaging with the rails 67 and 68. A clearance of 8 mm is given in the present embodiment. Also, configuration is given such that the sheet storage (sheet stacking unit) 62 can store long size sheets.

For this reason, a slight angle of the sheet storage 62 results in a large misalignment in a case where the rails 67*a* and 68*a* of the sheet storage 62 are not moved in parallel to the rails 67 and 68 of the sheet feeding apparatus 30 when the sheet storage 62 is being pushed in.

Figure 4:
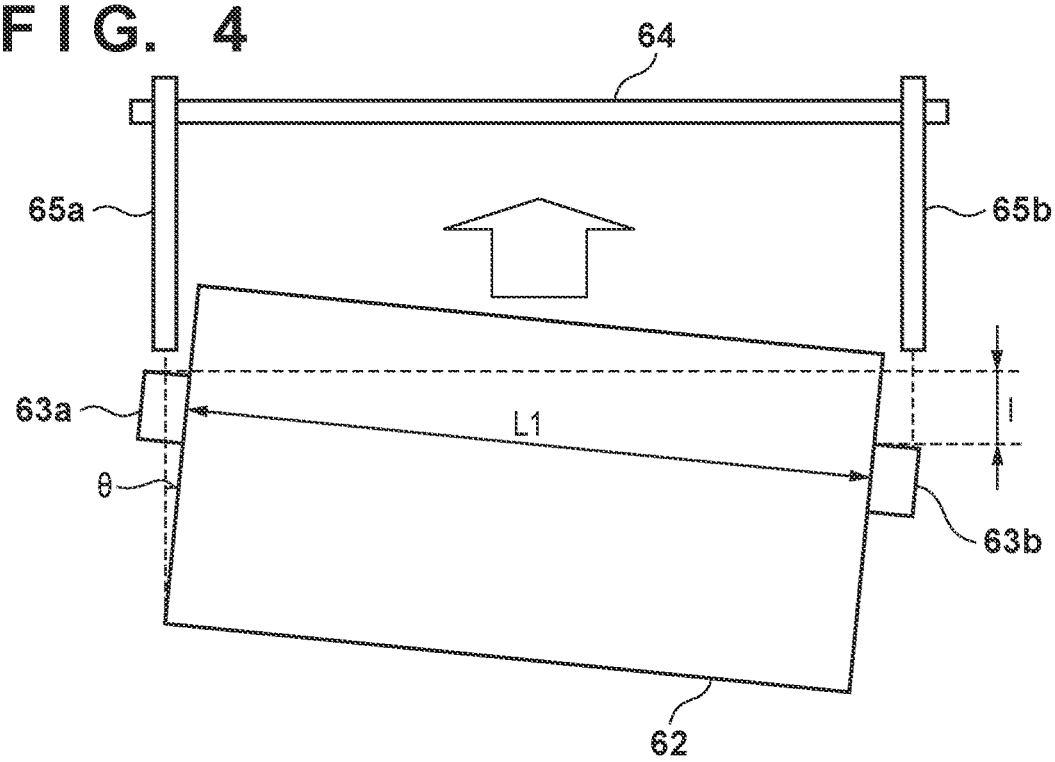
FIG. 4 is a schematic diagram illustrating a situation in which the sheet storage is pushed into the sheet feeding apparatus at an angle.

FIG. 4 is a schematic diagram illustrating a situation in which the sheet storage is pushed into the interior of the sheet feeding apparatus at an angle. In FIG. 4, L1 is the width between the rollers 63*a* and 63*b* (910 mm in this embodiment) and θ is the angle of the skew of the sheet storage 62 in relation to the running direction of the rails (the dashed lines). In the clearance (8 mm) in this embodiment, an angle, in other words a tilt, of a maximum of 1.5° may occur when considering warping of the rails.

As illustrated in FIG. 4, in a case where the sheet storage 62 is pushed at an angle in the arrow direction, the roller 63*a* reaches the latch 65*a* before the roller 63*b* reaches the latch 65*b* in the insertion direction. The larger the width L1 between rails is, the larger this difference (skew amount 1) becomes. For example, in a case where the skew angle θ is made to be 1.5°, which is the maximum, and L1 is made to be 910 mm, the skew amount 1 is roughly 23.8 mm. Accordingly, if it is not ensured that, from the position where one of the latches (the latch 65*a* in FIG. 4) engages the roller 63*a*, the latches are held up over at least a length of 23.8 mm (=skew amount 1), which is the range over which the other latch, the latch 65*b* in FIG. 4, will contact the roller 63*b*, a half-latched state will result. More specifically, a half-latched state in which only the latch 65*a* is engaged with the roller 63*a* and the latch 65*b* is not engaged with the roller 63*b* will occur. In a half-latched state, the sheet storage 62 will not be satisfactorily fixed with respect to the sheet feeding apparatus 30. As a result, sheet feeding becomes unstable and there is possibility that a conveyance error or a sheet jam will occur.

Figure 5A:
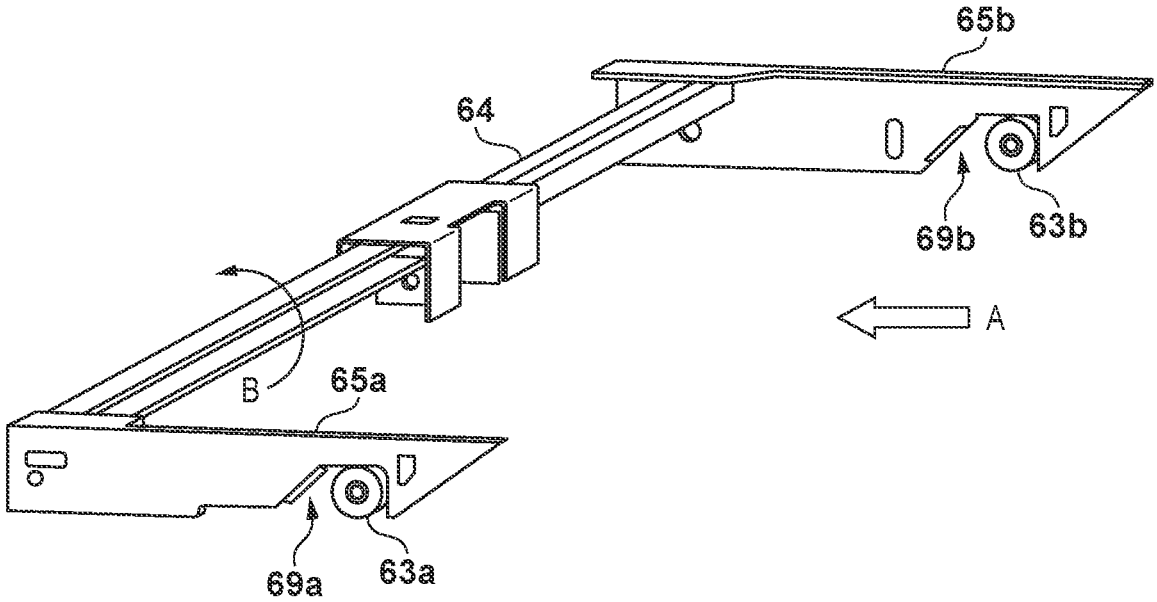
FIGS. 5A and 5B are perspective views illustrating rollers of the latch assembly and the sheet storage in a normally latched state and in a half-latched state.
Figure 5B:
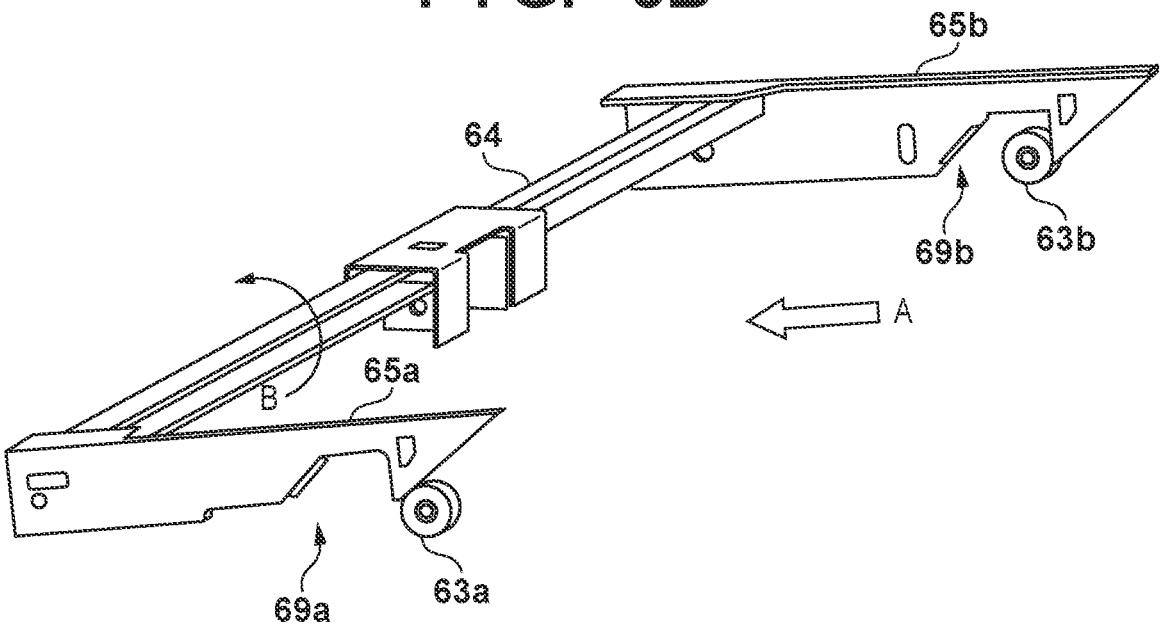

FIGS. 5A and 5B are perspective views illustrating a relationship between a conventional latch assembly and rollers of a sheet storage.

FIG. 5A is a view illustrating a situation in which the sheet storage 62 is properly pushed straight into the sheet feeding apparatus 30 and FIG. 5B is a view illustrating a situation in which the sheet storage 62 is pushed at an angle into the sheet feeding apparatus 30. FIGS. 5A and 5B are examples in which the two latches 65*a* and 65*b* which have triangular leading end portions are connected by the latch connecting portion 64 configure the latch assembly. The entire latch assembly is configured such that rotation around the rod axis of the rod-shaped latch connecting portion 64 is possible. For this reason, when the rollers move in the direction of the arrow symbol A, and the leading end portions of the latches contact with at least one of the two rollers 63*a* and 63*b*, and then the rollers move further in the direction of the arrow symbol A, the latch assembly rotates in the direction of the arrow symbol B riding up on the rollers.

According to FIG. 5A, the latch 65*a* and the latch 65*b* pass over the roller 63*a* and the roller 63*b*, respectively, and engage with concave portions 69*a* and 69*b* of the two latches. More specifically, the latch 65*a* and the latch 65*b* engage with the concave portion 69*a* and the concave portion 69*b*, respectively, and thereby the sheet storage 62 is correctly fixed to the sheet feeding apparatus 30. Meanwhile, according to FIG. 5B, the roller 63*a* does not get past the edge point between the leading end portion of the latch 65*a* and concave portion 69*a* although the roller 63*b* does get past the edge point between the leading end portion of the latch 65*b* and concave portion 69*b*. When the latch 65*a* and the latch 65*b* move downward in this state, the latch 65*b* engages with the roller 63*b* but the latch 65*a* does not engage with the roller 63*a* and comes down before doing so. As a result, the latch 65*a* does not engage and the above described half-latched state results. More specifically, the latch 65*b* engages with the roller 63*b* prior to the latch 65*a* reaching the position at which the roller 63*a* is engaged. Accordingly, there is a possibility that that in spite of a half-latched state in which the latch 65*a* is not engaged and the latch 65*b* is engaged, an operator will misunderstand and think that both sides of the latch 65*a* and the latch 65*b* have come down in a correctly engaged state, and finish the operation.

In this embodiment, the shape of the leading end portions of the latches is changed from a triangular shape to an approximately trapezoidal shape so that the left and right latches function normally even if the sheet storage 62 is pushed somewhat at an angle into the sheet feeding apparatus 30, for example.

Figure 6:
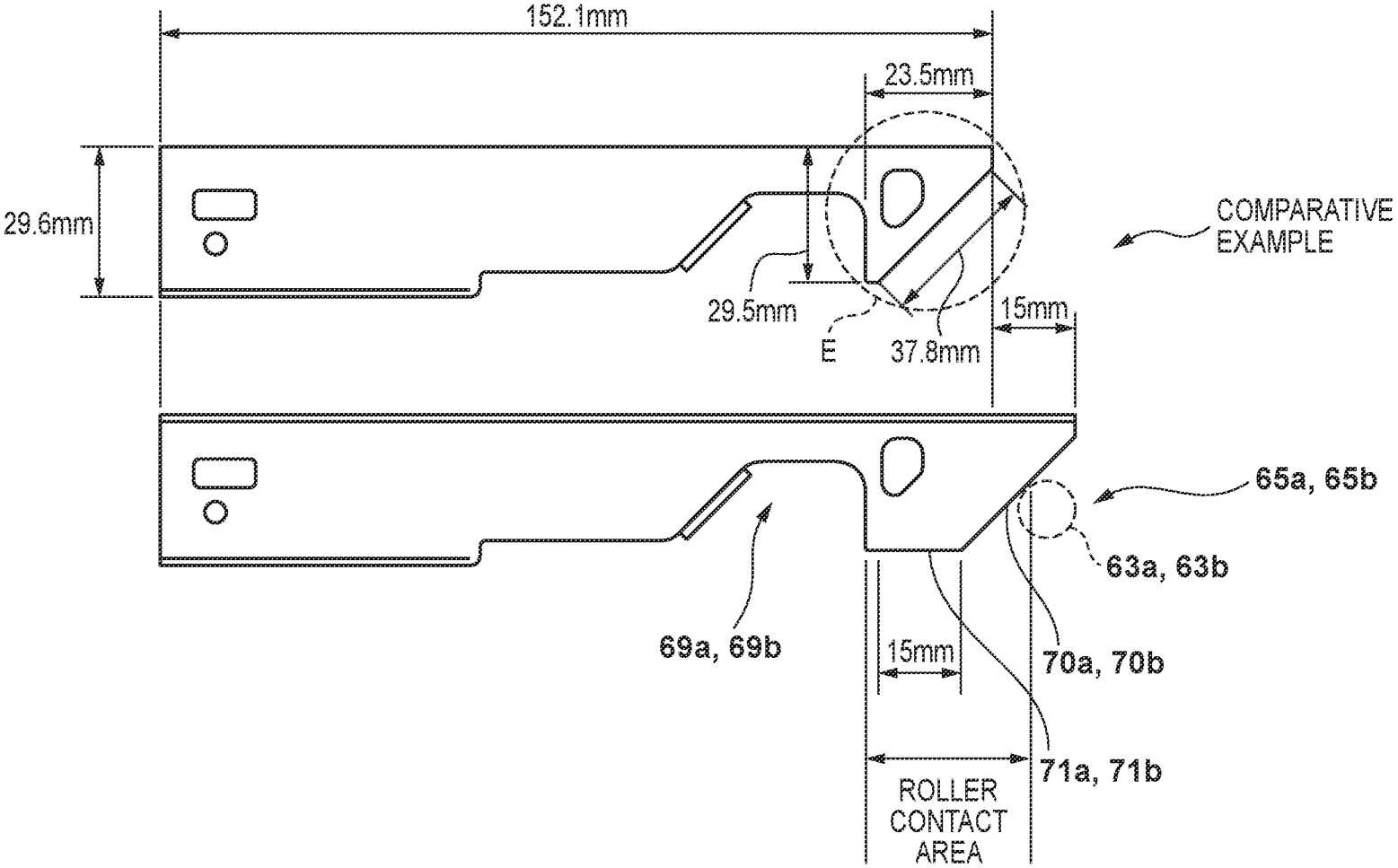
FIG. 6 is a side view illustrating the detailed shape of latches.

FIG. 6 is a side view illustrating a detailed shape of latch portions.

The view of the upper side of FIG. 6 illustrates the side of a conventional latch whose leading end portion is triangular as a comparative example and the view of the lower side of FIG. 6 illustrates the shape of the latches 65*a* and 65*b* according to the embodiment. The triangular dimensions of the comparative example are a=23.5 mm, b=29.5 mm, and c=37.8 mm. In the shape of the comparative example, it is not possible to ensure that the latches will be held up over a length of 23.8 mm, which is a range over which the latch 65*b* would contact the roller 63*b* and that is necessary for handling skewing which causes the above described half-latch. For this reason, in a case where a skew at a maximum angle occurs, there is a possibility that a half-latch will occur.

As understood from comparing the comparative example on the upper side with the latch of the present embodiment on the lower side, the leading end portion of the latch of the comparative example (the dashed line E portion) is triangular whereas the leading end portion of the latch of the present embodiment is trapezoidal. More specifically, the shape of the leading end portion of the latch of the present embodiment extends the shape of the leading end portion of the latch of the comparative example in the direction of extension and makes the triangular shape approximately trapezoidal.

In the embodiment, the leading end portions of the latches 65*a* and 65*b* are extended 15 mm in the direction of extension and short side portions 71*a* and 71*b* of a length of 15 mm are formed. By this, a range over which the roller 63*b* contacts the latch 65*b* of 23.8 mm or greater can be maintained. More specifically, the roller contact area in FIG. 6 is equal to/more than the maximum value of the skew amount 1 shown in FIG. 4. For this reason, even in a case where a skew at a maximum angle occurs, there is no possibility of a half-latch occurring. Also, the above described shape is not limited to a wholly trapezoidal shape.

In summary, configuration is taken such that the latches 65*a* and 65*b* in the embodiment respectively have structures in which their leading end portion have the trapezoidal shape inclined face portions 70*a* and 70*b*, short side portions 71*a* and 71*b*, and concave portions 69*a* and 69*b* in this order in the insertion direction.

The shape of the leading end portions of the latches which have a length of 152.1 mm and a height of 29.6 mm in the comparative example is extended by 15 mm in the direction of extension and the extended length is the length of the short sides of the approximately trapezoidal shapes in the example illustrated in FIG. 6. Accordingly, an increase in size in the direction of extension of the size of the latches in the embodiment is limited at less than 10%. For this reason, it is possible to configure such that there is no change of the size of the housing of the sheet feeding apparatus 30 that accommodates the sheet storage 62.

In the embodiment, the latch assembly that employs a latch with the leading end portion having the above described shape is equipped within the sheet feeding apparatus 30.

Next, description is given with reference to a drawing of a situation in which the sheet storage 62 of the above described configuration is pushed at an angle into the sheet feeding apparatus 30 of the above described configuration.

Figure 7:
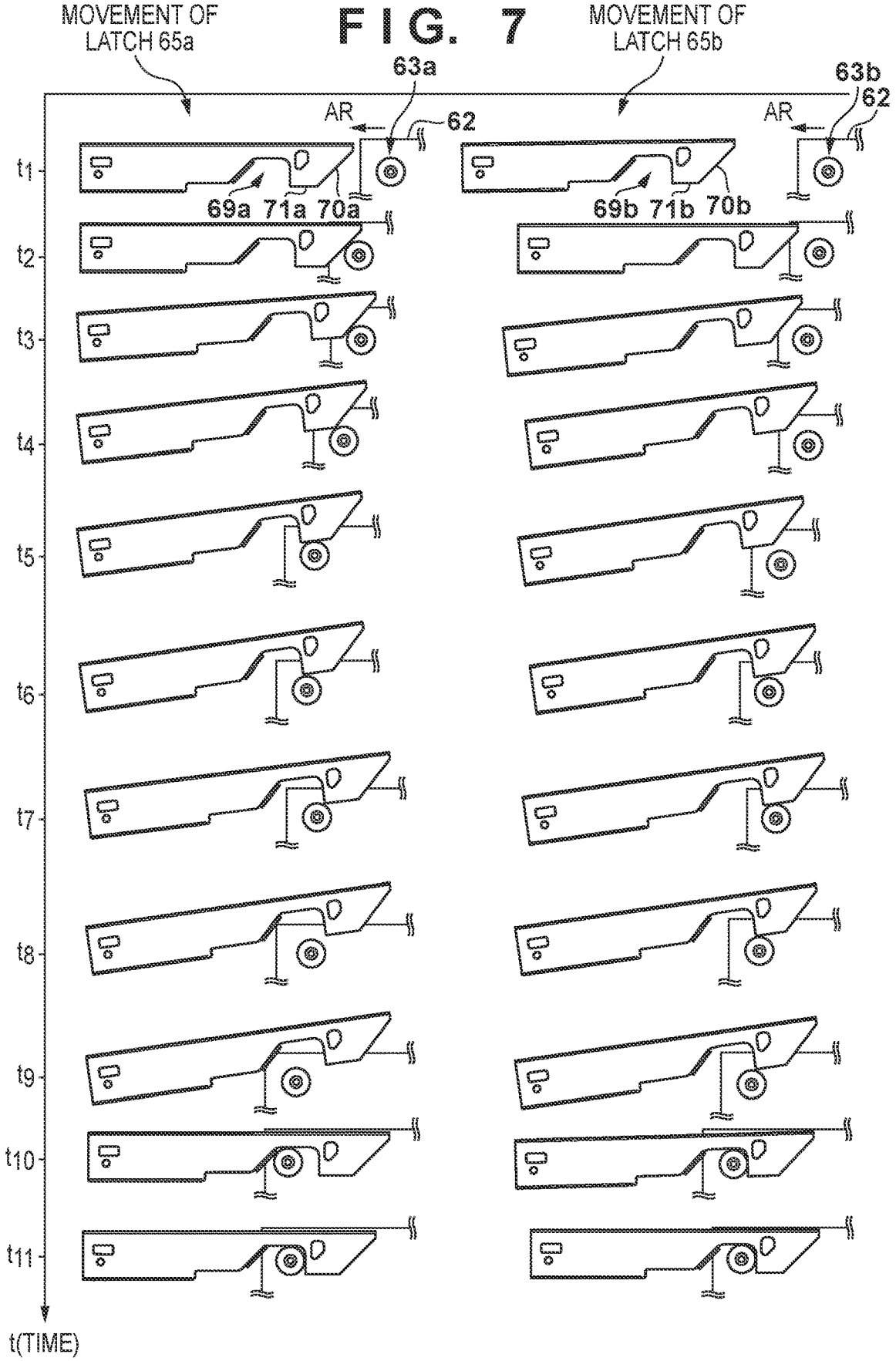
FIG. 7 is a view illustrating a time-dependent transition of the relative positional relationship of the two rollers of the two latches in a case where the sheet storage is pushed into the sheet feeding apparatus at an angle.

FIG. 7 is a view illustrating a time-dependent transition of the relative positional relationship of the two rollers of the two latches in a case where the sheet storage is pushed into the sheet feeding apparatus at an angle.

In FIG. 7, the left side illustrates a time-dependent transition of the relative positional relationship of the latch 65*a* and the roller 63*a* and the right side illustrates a time-dependent transition of the relative positional relationship of the latch 65*b* and the roller 63*b*. Also, in FIG. 7, time (t) transitions from $t=t_1$ to $t_2$ . . . to $t_{11}$ in the vertical direction from top to bottom. Also, the sheet storage 62 is pushed into the sheet feeding apparatus 30 in accordance with this transition. Accordingly, in FIG. 7, the relative positional relationship between the latch 65*a* and the roller 63*a* can be compared with the relative positional relationship between the latch 65*b* and the roller 63*b* at the same time. Also, the arrow symbol AR indicates the insertion direction of the sheet storage 62 in FIG. 7.

Hereinafter, description is given regarding the relative positional relationship between the two latches and the two rollers in accordance with the transition of time when the sheet storage 62 is pushed at an angle into the sheet feeding apparatus 30. Here, as illustrated in FIG. 4, a case in which the roller 63*a* reaches the latch 65*a* before the roller 63*b* reaches the latch 65*b* is envisioned. Of course, it goes without saying that the present invention can be applied in a case opposite to this, specifically, in a case where the roller 63*b* reaches the latch 65*b* before the roller 63*a* reaches the latch 65*a*.

$t=t_1$

The roller 63*a* of the sheet storage 62 gets close to the leading end portion of the latch 65*a* first. In contrast, there is still a distance until the roller 63*b* of the sheet storage 62 reaches the leading end portion of the latch 65*b*.

$t=t_2$

The roller 63*a* of the sheet storage 62 first contacts the inclined face portion 70*a* of the leading end portion of the latch 65*a*. In contrast, the roller 63*b* of the sheet storage 62 has not reached the latch 65*b*.

$t=t_3$

The roller 63*a* abuts the inclined face portion 70*a* of the leading end portion of the latch 65*a* and the latch 65*a* is gradually lifted. In contrast to this, although the latch 65*b* does not contact the roller 63*b* of the sheet storage 62, the latch 65*b* lifts up because it is integrated with the latch 65*a* as the latch assembly.

$t=t_4$

After the roller 63*a* contacts the inclined face portion 70*a* of the leading end portion of the latch 65*a* and the latch 65*a* is gradually lifted, the roller 63*a* reaches the point between the inclined face portion 70*a* of the leading end portion of the latch 65*a* and the short side portion 71*a*. In contrast to this, although the latch 65*b* does not contact the roller 63*b* of the sheet storage 62, the latch 65*b* lifts up because it is integrated with the latch 65*a* as the latch assembly.

$t=t_5$

The roller 63*a* moves in a state in which the short side portion 71*a* rides on the roller 63*a* and the short side portion 71*a* and the roller 63*a* abut. In contrast to this, although the latch 65*b* is still not in contact with the roller 63*b*, the roller 63*b* approaches the latch 65*b* while the latch 65*b* is lifted.

$t=t_6$

A state in which the roller 63*a* passes the short side portion 71*a* and the short side portion 71*a* rides on the roller 63*a* ends. In contrast, the latch 65*b* is in a state in which the short side portion 71*b* rides on the roller 63*b* and the roller 63*b* moves under the short side portion 71*b*.

$t=t_7$

The roller 63*a* passes the short side portion 71*a* and a state in which the short side portion 71*a* rides on the roller 63*a* ends. In contrast, a state continues in which the roller 63*b* has not passed the short side portion 71*b* and the short side portion 71*b* rides on the roller 63*b*. A state is maintained in which the latch 65*a* is lifted up because it is integrated with the latch 65*b* as the latch assembly.

$t=t_8$

This is immediately prior to the state in which the short side portion 71*b* rides on the roller 63*b* ends. The state in which the short side portion 71*a* rides on the roller 63*a* has ended. A state is maintained in which the latch 65*a* is lifted up because it is integrated with the latch 65*b* as the latch assembly.

$t=t_9$

The roller 63*b* passes the short side portion 71*b* of the latch 65*b* and the state in which the short side portion 71*b* rides on the roller 63*b* ends. Also, the roller 63*b* moves to the concave portion 69*b* of the latch 65*b* which is the engagement position. At that time, the latch 65*b* starts the engagement operation with the roller 63*b*. In synchronization with this, the latch 65*a* integrally operating with the latch 65*b* as the latch assembly also starts the engagement operation.

$t=t_{10}$

The roller 63*b* passes the short side portion 71*b*, and when it reaches the concave portion 69*b* which is the engagement position, the roller 63*a* has already passed the short side portion 71*a* and reached the concave portion 69*a* which is the engagement position. For this reason, when the latch 65*b* engages with the roller 63*b*, the latch 65*a* also can engage with the roller 63*a*. When engaged, the latch 65*a* enters an engaged state with the roller 63*a* at the deepest part (left end in the figure) of the concave portion 69*a* and the latch 65*b* enters an engaged state with the roller 63*b* at the frontmost part (right end in the figure) of the concave portion 69*b*.

$t=t_{11}$

The latch 65*a* and the roller 63*a* and the latch 65*b* and the roller 63*b* are in an engaged state and the sheet storage 62 is fixed to the sheet feeding apparatus 30. When the sheet storage 62 is pushed further into the sheet feeding apparatus 30 in this state, a state is entered in which the latch 65*a* is engaged at the frontmost part of the concave portion 69*a* and the latch 65*b* is engaged at the frontmost part of the concave portion 69*b*. Thereby, the state in which the sheet storage 62 has been pushed at an angle into the sheet feeding apparatus 30 is resolved.

In summary, when the sheet storage 62 is pushed at the maximum tilt angle into the sheet feeding apparatus 30 along the insertion direction, if the roller 63*a* has reached the engagement position for the latch 65*a* and the roller 63*b* has not reached the engagement position for the latch 65*b* yet, the latch 65*a* does not engage with the roller 63*a* and the latch 65*b* does not engage with the roller 63*b*. And, when not only the roller 63*a* has reached the engagement position for the latch 65*a* but also the roller 63*b* has reached the engagement position for the latch 65*b*, the latch 65*a* engages with the roller 63*a* and the latch 65*b* engages with the roller 63*b*.

In accordance with the embodiment described above, by changing the shape of the leading edge of the latches, it is possible to latch both sides of the sheet storage without a half-latched state occurring even if the sheet storage is pushed into the sheet feeding apparatus in an angled state with respect to the sheet feeding apparatus. Accordingly, it becomes possible to prevent an occurrence of a half-latched state in a simple configuration without introducing an increase of parts and without arranging sensors for detecting a half-latched state and using a complex mechanism that controls the latches in accordance with the detection.

Furthermore, in a case where a half-latched state occurs in the conventional configuration, the user would manually resolve the half-latched state and perform an additional operation of ejecting the sheet storage and re-inserting it into the sheet feeding apparatus. However, by virtue of the embodiment, additional operations become unnecessary and there is the advantage of user convenience being improved.

Furthermore, in the above described embodiment, although the sheet feeding apparatus and the image forming apparatus are configured as separate bodies, rather than being limited by this, the present invention may also be configured such that the sheet feeding apparatus is integrated in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2017-245363, filed Dec. 21, 2017, and 2018-228301, filed Dec. 5, 2018, which are hereby incorporated by reference herein in their entirety.

What is claimed is:

1. A sheet feeding apparatus that feeds sheets to an image forming apparatus comprising:

a housing;

a storage unit that is accommodated within the housing and that has a sheet stacking unit that stacks sheets, and that is movable in an insertion direction with respect to the housing;

a first rotating body arranged at one end in a direction that intersects with the insertion direction of the storage unit;

a second rotating body arranged at the other end in the direction that intersects with the insertion direction of the storage unit;

a first latch portion that is provided in the housing and engages with the first rotating body;

a second latch portion that is provided in the housing and engages with the second rotating body;

a connecting portion that connects the first latch portion and the second latch portion; and a feed unit configured to feed a sheet stacked in the sheet stacking unit to the image forming apparatus, wherein the housing includes the first latch portion, the second latch portion, the connecting portion, and the feed unit, the storage unit includes the first rotating body and the second rotating body, the first latch portion and the second latch portion are connected by the connecting portion and move integrally, in a case where the storage unit is inserted at a maximum angle with respect to the housing, the first latch portion does not engage with the first rotating body and the second latch portion does not engage with the second rotating body at a time when the first rotating body reaches an engagement position for the first latch portion in the insertion direction and the second rotating body does not reach an engagement position for the second latch portion in the insertion direction, and the first latch portion engages with the first rotating body and the second latch portion engages with the second rotating body at a time when the first rotating body reaches the engagement position for the first latch portion in the insertion direction and the second rotating body reaches the engagement position for the second latch portion in the insertion direction.

2. The apparatus according to claim 1, wherein the first latch portion and the second latch portion engage by moving downward, and the first latch portion and the second latch portion are held upward from when the first rotating body and the first latch portion come into contact until the first rotating body and the second rotating body reach the engagement positions for their corresponding latch portions in the insertion direction.

3. A sheet feeding apparatus comprising:

a housing;

a storage unit that is accommodated within the housing and that has a sheet stacking unit that stacks sheets, and that is movable in an insertion direction with respect to the housing and an opposite direction of the insertion direction;

a first rotating body arranged at one end in a direction that intersects with the insertion direction of the storage unit;

a second rotating body arranged at the other end in a direction that intersects with the insertion direction of the storage unit;

a first latch portion that is provided in the housing and engages with the first rotating body;

a second latch portion that is provided in the housing and engages with the second rotating body;

a connecting portion that connects the first latch portion and the second latch portion; and a feed unit configured to feed the sheets stacked in the sheet stacking unit to an image forming apparatus, wherein the housing includes the first latch portion, the second latch portion, the connecting portion, and the feed unit, the storage unit includes the first rotating body and the second rotating body, the first latch portion and the second latch portion are connected by the connecting portion, the first latch portion and the second latch portion each include in order from a head portion in the insertion direction:

an inclined face portion that inclines with respect to the insertion direction;

a short side portion that is connected to the inclined face portion and forms an angle with the insertion direction, the angle being less than an angle between the inclined face portion and the insertion direction; and a concave portion that connects to the short side portion and engages with a corresponding rotating body, and in a case where the storage unit is inserted at a maximum angle with respect to the housing, a length in the insertion direction from a position of the inclined face portion at which a corresponding rotating body initially contacts to a position at which the concave portion connects to the short side portion is longer than a distance in the insertion direction between the first rotating body and the second rotating body.

4. An image forming apparatus comprising:

a sheet feeding apparatus; and an image forming unit configured to form an image onto a sheet that the sheet feeding apparatus feeds, wherein the sheet feeding apparatus comprises:

a housing;

a storage unit that is accommodated within the housing and that has a sheet stacking unit that stacks sheets, and that is movable in an insertion direction with respect to the housing and an opposite direction of the insertion direction;

a first rotating body arranged at one end in a direction that intersects with the insertion direction of the storage unit;

a second rotating body arranged at the other end in a direction that intersects with the insertion direction of the storage unit;

a first latch portion that is provided in the housing and engages with the first rotating body;

a second latch portion that is provided in the housing and engages with the second rotating body;

a connecting portion that connects the first latch portion and the second latch portion; and a feed unit configured to feed the sheets stacked in the sheet stacking unit to the image forming apparatus, wherein the housing includes the first latch portion, the second latch portion, the connecting portion, and the feed unit, the storage unit includes the first rotating body and the second rotating body, the first latch portion and the second latch portion are connected by the connecting portion, the first latch portion and the second latch portion each include in order from a head portion in the insertion direction:

an inclined face portion that inclines with respect to the insertion direction;

a short side portion that is connected to the inclined face portion and forms an angle with the insertion direction, the angle being less than an angle between the inclined face portion and the insertion direction; and a concave portion that connects to the short side portion and engages with a corresponding rotating body, and in a case where the storage unit is inserted at a maximum angle with respect to the housing, a length in the insertion direction from a position of the inclined face portion at which a corresponding rotating body initially contacts to a position at which the concave portion connects to the short side portion is longer than a distance in the insertion direction between the first rotating body and the second rotating body.

* * * * *